US006028274A

United States Patent [19]

Harris

[11] Patent Number: 6,028,274

[45] Date of Patent: Feb. 22, 2000

[54] FAIL-SAFE SWITCH

[76] Inventor: Timothy S. Harris, 2925 Lincolndale Ave., Fort Wayne, Ind. 46808

[21] Appl. No.: 09/021,196

[22] Filed: Feb. 10, 1998

[51] Int. Cl.[7] ..... H01H 9/00; H01H 1/00

[52] U.S. Cl. ..... 200/52 R; 200/16 B; 200/520; 200/524; 200/243; 200/DIG. 42

[58] Field of Search ..... 200/1 R, 1 V, 200/520–536, 243, DIG. 42, 16 B, 52 R; 324/418

[56] References Cited

U.S. PATENT DOCUMENTS

| | | | |
|---|---|---|---|
| 3,953,697 | 4/1976 | Teichert | 200/243 |
| 4,368,444 | 1/1983 | Preuss et al. | 335/166 |
| 4,546,224 | 10/1985 | Mostosi | 200/401 |
| 4,645,886 | 2/1987 | Williams | 200/1 R |
| 4,647,727 | 3/1987 | Sontheimer | 200/1 R |
| 4,829,147 | 5/1989 | Schiefen et al. | 200/17 R |
| 4,951,019 | 8/1990 | Gula | 335/166 |
| 5,142,112 | 8/1992 | Parks et al. | 200/401 |
| 5,165,532 | 11/1992 | Pipich et al. | 200/327 X |
| 5,304,753 | 4/1994 | Parrish et al. | 200/16 B |

*Primary Examiner*—J. R. Scott
*Attorney, Agent, or Firm*—Kolisch, Hartwell, Dickinson, McCormack & Heuser

[57] ABSTRACT

A safety switch with a contactor structure including first and second contactor contacts electrically connected to each other. The switch has an "on" state in which first and second terminal contacts are contacted with the first and second contactor contacts, respectively, to thereby electrically connect the terminal contacts therebetween, and an "off" state in which the terminal contacts are not electrically connected to each other by the contactor structure, whereby current cannot flow between the terminal contacts. The switch also has a cycle control mechanism with a normal-state in which the switch is free to cycle between the "on" and "off" states, and a welded-state in which one of the terminal contacts is welded to one of the contactor contacts and the other of the contactor contacts is separated from the other of the terminal contacts. When the cycle control mechanism is in the welded state, the switch is prevented from moving from the "off" state to the "on" state.

18 Claims, 6 Drawing Sheets

Fig. 11
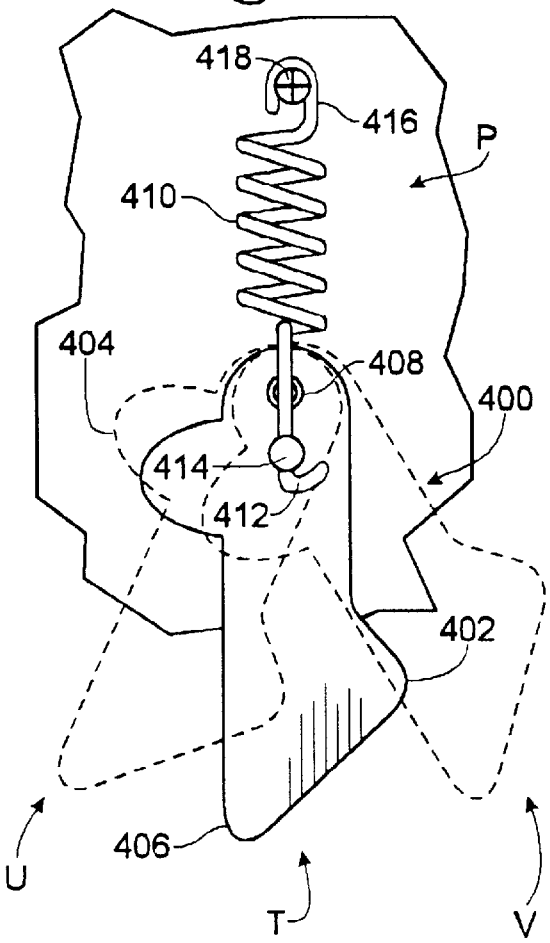
Fig. 12
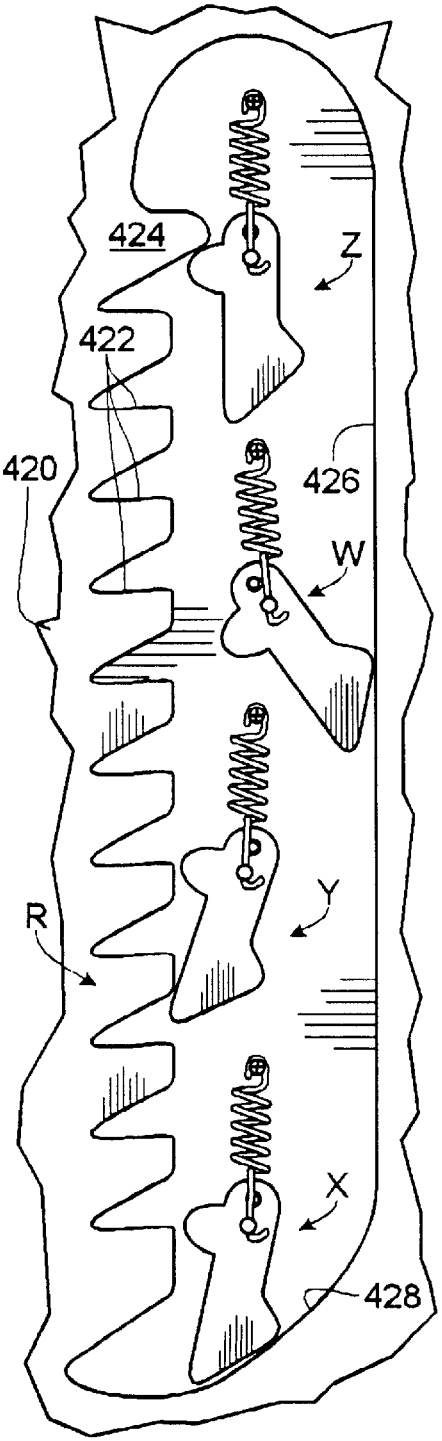
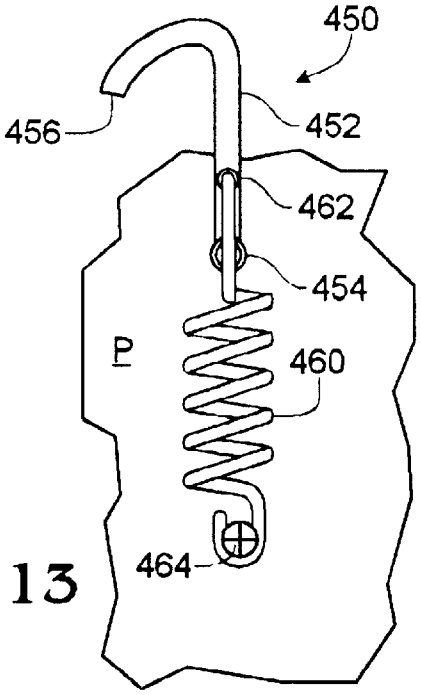
Fig. 13

FAIL-SAFE SWITCH

FIELD OF THE INVENTION

The present invention is directed to a fail-safe electrical switch. More particularly, the present invention is directed to a fail-safe electrical switch that cannot be reactivated if a contact becomes welded.

BACKGROUND OF THE INVENTION

Manually-actuable electrical switches are used in many applications and allow a user to connect and disconnect current in an electrical circuit. Such switches can be found in household lighting, flashlights, and battery-operated toys. A simple switch typically has a moveable contact which completes an electrical circuit. In situations requiring a higher degree of safety and/or reliability, two moveable contacts are used, both of which must be connected for the circuit to be made. A typical "two-contact" type of switch is operated by moving a conductive bar against a pair of contacts to provide an electrical path. The bar is moved away from the contacts when the switch is turned off. For some kinds of loads—high current and inductive—a considerable amount of electrical arcing can occur when the bar closes against and releases from the contacts. The heat generated by this arcing can sometimes melt a portion of the metal contact surface, which can result in the bar being "welded" to one of the contacts.

The bar only welds to one contact at a time because arcing only occurs on the side of the bar making or breaking the current path. More specifically, when the bar touches the first contact no current flows. Only when the second contact is touched does current begin to flow. This initiation of current is what can lead to arcing, and potentially, welding of the contacts. Likewise, when the contacts are broken, arcing only occurs at the first of the two contacts to break. Thus, only one contact at a time is subject to becoming welded, and it is extremely unlikely that the switch will become fused in the "on" state in a single contact cycle.

Once the first contact is welded in a two-contact switch, the switch can normally still be operated by making or breaking the connection between the bar and the non-welded contact. However, in this situation arcing is likely to occur between the bar and the non-welded contact in every subsequent contact cycle. Although the user may have no indication that one of the contacts is welded, there is now a substantial risk that both contacts will become welded and the switch will not turn off. In some applications such as motorized toy vehicles, it can be very dangerous for a switch not to turn off.

Previous switch designs used complex mechanisms to prevent the switch from permanently fusing closed. Other simpler designs were not dependable when the switch was required to be frequently operated.

It is therefore an object of the present invention to provide a fail-safe electrical switch that cannot be reactivated when an internal contact becomes welded.

It is a further object of the present invention to provide a fail-safe "two-contact" switch wherein the switch is rendered inoperative when one of the two contacts becomes welded.

It is a further object of the present invention to provide a normally-open fail-safe switch that can be used in applications requiring a high degree of safety.

It is a further object of the present invention to provide a fail-safe electrical switch that is economical to produce.

It is a further object of the present invention to provide a fail-safe electrical switch having a simple structure.

SUMMARY OF THE INVENTION

The difficulties and problems found in past electrical switches are overcome by providing a safety switch with a contactor structure including first and second contactor contacts electrically connected to each other. The switch has an "on" state in which first and second terminal contacts are contacted with the first and second contactor contacts, respectively, to thereby electrically connect the terminal contacts therebetween, and an "off" state in which the terminal contacts are not electrically connected to each other by the contactor structure, whereby current cannot flow between the terminal contacts. The switch also has a cycle control mechanism with a normal-state in which the switch is free to cycle between the "on" and "off" states, and a welded-state in which one of the terminal contacts is welded to one of the contactor contacts and the other of the contactor contacts is separated from the other of the terminal contacts. When the cycle control mechanism is in the welded state, the switch is prevented from moving from the "off" state to the "on" state.

Alternatively, a switch is provided having a conductive element with first and second ends, the first end removably contacting one of the stationary contacts and the second end removably contacting the other of the stationary contacts. The switch has an actuable plunger and is thereby manipulable between an "off" state in which at least one end of the conductive element is not in contact with the stationary contacts, and an "on" state in which both ends of the conductive element contact the stationary contacts. Once the switch is actuated to the "on" state, the switch must attain the "off" state prior to returning to the "on" state. A cycle control surface, such as a cam surface, is disposed in relation to the plunger and has at least one lobe. A cam follower is moveable with respect to the surface as the plunger is actuated and released. When the switch is operating normally, the cam follower moves with respect to the plunger as the switch is manipulated between the "off" state and the "on" state. When one of the first and second ends of the conductive element is fused to the respective one of the stationary contacts, the cam follower is prevented from leaving the lobe, thus preventing the cam follower from moving with respect to the plunger. The switch is prevented from attaining the "on" state and therefore is rendered inoperative.

These and other objects, advantages and novel features of the invention will be set forth in part in the description which follows.

BRIEF DESCRIPTION OF THE DRAWINGS

FIGS. 11 and 12 show a swing-arm and ratchet mechanism according to still another embodiment of the present invention.

FIG. 13 shows a hook-shaped arm according to still another embodiment of the present invention.

DETAILED DESCRIPTION OF THE PREFERRED EMBODIMENTS

Figure 1:
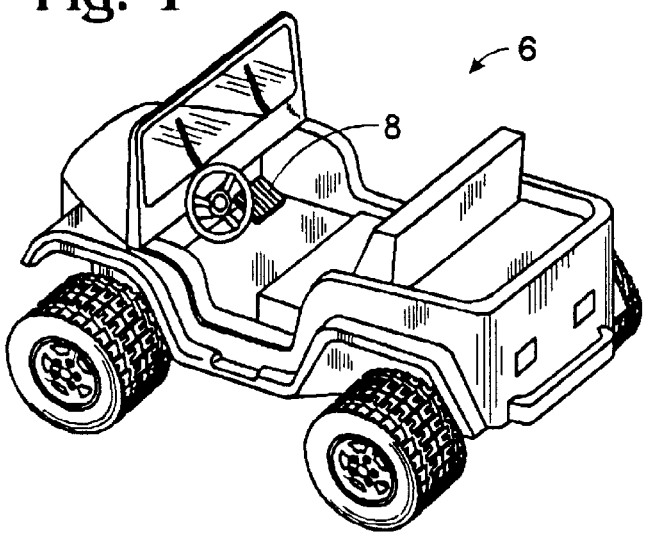
FIG. 1 is a perspective view of a vehicle which uses a switch of the present invention.

FIG. 1 shows an electrically-powered toy ride-on vehicle 6 having a pedal 8. Pedal 8 is pressed when an operator wants vehicle 6 to move. Pedal 8 is released when the operator wants vehicle 6 to stop. A switch according to the present invention is actuated by pedal 8 and allows electrical current from a source of motive power (not shown) to flow to a drive train (not shown). A dynamic braking mechanism (not shown) can be provided to brake vehicle 6 when the pedal is not actuated. An electrical circuit having a source of motive power, a drive train, and a dynamic braking mechanism, is shown in U.S. Pat. No. 5,304,753, which is hereby incorporated by reference in its entirety.

Figure 2:
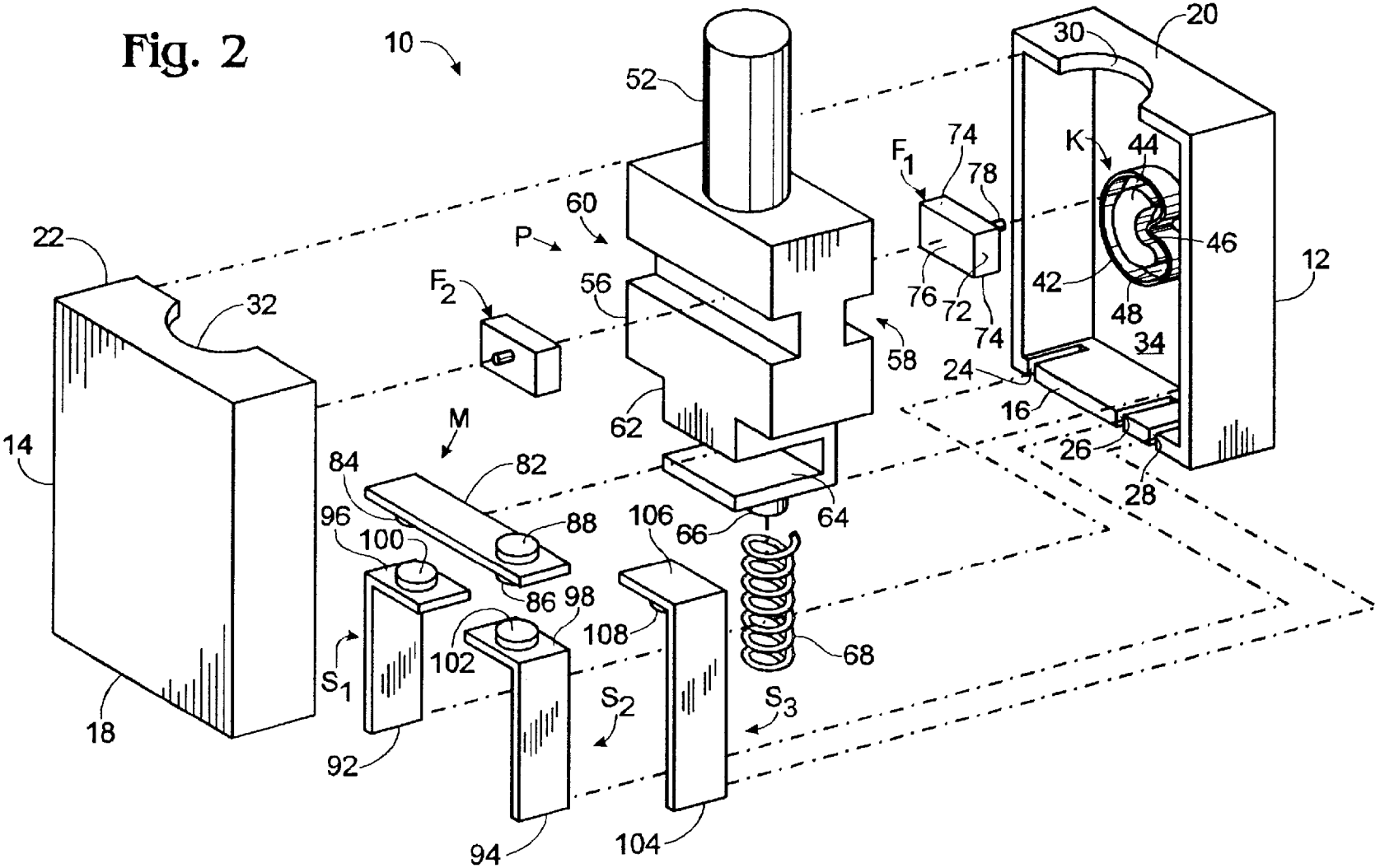
FIG. 2 is an exploded view of a switch according to one embodiment of the present invention.

A fail-safe switch according to one embodiment of the present invention is shown in FIG. 2 and is indicated generally at 10. Switch 10 includes a housing comprising two halves 12 and 14. Each housing half 12, 14 has a bottom 16, 18 and a top 20, 22, respectively. Bottom 16 of first housing half 12 has a plurality of contact slots 24, 26, and 28. Contact slots 24, 26, 28 could also be partially made in bottom 18 of second housing half 14 so that contact slots of sufficient size would be created when housing halves 12, 14 are placed together. Each of tops 20, 22 of housing halves 12, 14 has a semi-circular cut 30, 32. When housing halves 12, 14 are placed together, semi-circular cuts 30, 32 form a circular hole in the top of switch 10.

Inner wall 34 of first housing half 12 has a cycle control surface in the form of a heart-shaped cam K. Cam K has an outer ridge 42 which surrounds an inner solid portion 44. Inner solid portion 44 includes a trap which takes the form of a lobe 46. The inner solid portion and the outer ridge define a cam track 48 therebetween. A similar cam (not shown) is formed on second housing half 14.

An actuating mechanism, which takes the form of a plunger P, is disposed between housing halves 12, 14. Plunger P has a stem 52 which extends through the circular hole formed by semi-circular cuts 30, 32. Stem 52 is generally cylindrical in shape and allows switch 10 to be manually actuated. The stem is attached to a main body 56 of plunger P. The main body has cam grooves 58, 60 disposed on opposite sides of main body 56. A lower portion 62 of plunger P has a reduced width relative to main body 56. Lower portion 62 has a moveable contact slot 64 and a spring boss 66. One end of a compression spring 68 is mounted on the spring boss. A depression or boss (not shown) is provided on at least one of bottoms 16, 18 of housing halves 12, 14 for mounting the other end of the spring. Spring 68 upwardly biases plunger P.

Contacting members or path-following members in the form of cam followers $F_1$, $F_2$ are disposed in cam grooves 58, 60. Although two cam followers are shown in the embodiment in FIG. 2, the present invention can be practiced using only one cam follower. Since cam followers $F_1$, $F_2$ are substantially identical and operate in substantially the same manner, operation of cam follower $F_1$ will be described below. Cam follower $F_1$ comprises a body 72 with surfaces 74, 76 designed to contact cam groove 58. Cam follower $F_1$ is constrained by cam groove 58 to move in a vertical direction with plunger P. However, plunger P does not limit horizontal movement of cam follower $F_1$. Cam follower $F_1$ slides horizontally within cam groove 58 as plunger P moves vertically. Cam follower $F_1$ has a pin or boss 78 which moves along cam track 48 as plunger P is actuated.

A contactor structure or conductive element, shown as a moveable contact M, is disposed within moveable contact slot 64. Moveable contact M comprises a conductive strip 82 which is somewhat flexible and resilient. Two contactor contacts or contact areas, shown as button contact elements 84, 86, are disposed on the lower side of conductive strip 82. An additional button contact element 88 is also provided in the embodiment shown in FIG. 2. During normal operation of switch 10, vertical movement of plunger P causes moveable contact M to move vertically. Moveable contact M is prevented from moving in a substantially horizontal direction.

Each of two substantially identical terminal contacts $S_1$, $S_2$ comprise a terminal end 92, 94 which extends through one of contact slots 24, 26. Terminal ends 92, 94 are adapted to connect to an electrical circuit (not shown). Each terminal contact further comprises an angled end 96, 98. Button contact elements 100, 102 are positioned so that normal actuation of plunger P causes each of button contact elements 84, 86 on moveable contact M to abut one of the button contact elements.

A third terminal contact $S_3$ is provided in the embodiment shown in FIG. 2. Third terminal contact $S_3$ has a terminal end 104 extending through contact slot 28. Terminal end 104 can be connected to the dynamic braking mechanism (not shown) as is known in the art. Angled end 106 of third terminal contact $S_3$ has a button contact element 108 which is situated directly above button contact element 88 on moveable contact M.

Figure 3:
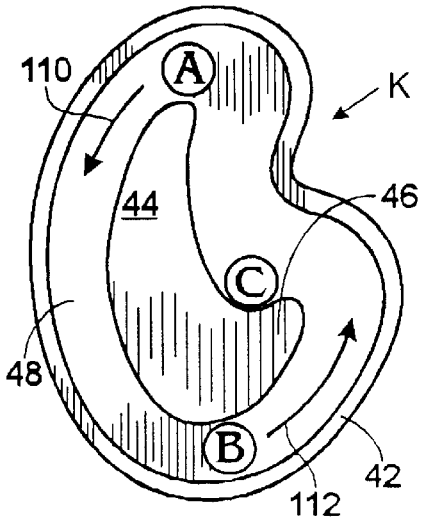
FIG. 3 is a side view of a cam according to the present invention.

Operation of switch 10 will now be described with reference to FIG. 3, which shows the position of pin 78 in track 48. When switch 10 is in a non-actuated state, the force of spring 68 biases plunger P upward so that button contact elements 84, 86 on moveable contact M do not contact button contact elements 100, 102 on terminal contacts $S_1$, $S_2$. Button contact element 88 contacts button contact element 108 on terminal contact $S_3$. Pin 78 is at non-actuated position A in FIG. 3. When plunger P is actuated in a downward direction, button contact elements 88 and 108 are removed from contact with each other. Cam follower $F_1$, disposed in cam groove 58, is constrained to move with plunger P in a downward direction. However, cam follower $F_1$ is free to move within cam groove 58 in a horizontal direction, thus allowing pin 78 to move along track 48 in a counterclockwise direction as shown by arrow 110. When pin 78 reaches actuated position B, button contact elements 84, 86 contact button contact elements 100, 102. Current runs through conductive strip 82. The electrical connection between terminal ends 92, 94 is made.

Under normal conditions, release of plunger P will result in switch 10 returning to the non-actuated state as described above. Pin 78 returns to non-actuated position A by following the path shown by arrow 112. Lobe 46 is designed so that the force of spring 68 is sufficient to move the pin from actuated position B to non-actuated position A without the lobe impeding movement of the pin. Once pin 78 has moved past lobe 46, it must move to non-actuated position A before returning to actuated position B. However, if one of button contact elements 84, 86 becomes welded to one of button contact elements 100, 102, release of plunger P will not result in pin 78 moving from position B to position A. Instead, the pin can only move from position B to fail-safe position C. Fail-safe position C is adjacent to lobe 46. Because moveable contact M is somewhat flexible, spring 68 forces the non-welded button contact element 84 or 86 out of contact with its respective button contact element 100 or 102. When pin 78 is in fail-safe position C, lobe 46 prevents downward movement of the pin. The welded button contact elements prevent upward movement of pin 78. The pin therefore stays at fail-safe position C as long as any of button contact elements 84, 86, 100, 102 are in a welded condition. Since plunger P and pin 78 are constrained by cam groove 58 to move vertically together, plunger P is also prevented from moving vertically. The non-welded button contact elements are prevented from contacting each other. Switch 10 is thereby rendered inoperative as long as a welded condition exists between any of contact elements 84, 86 and 100, 102.

Figure 4:
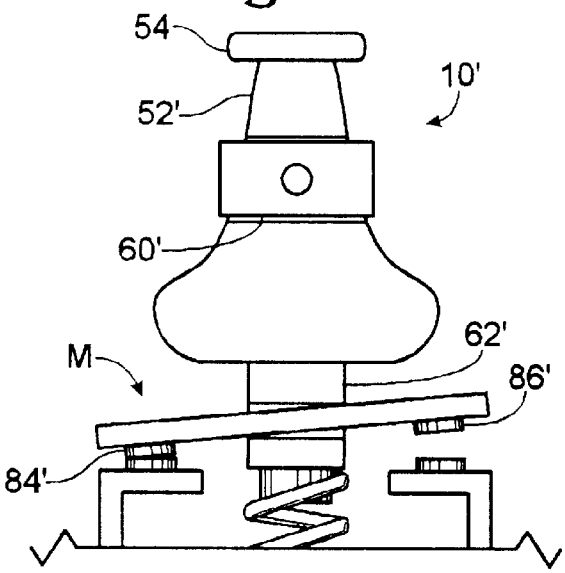
FIG. 4 is a side view of a switch according to another embodiment of the present invention.

FIG. 4 shows operation of the internal elements of a switch 10' which is a variation of switch 10. Parts common to switch 10 and switch 10' are represented by similar reference numbers in FIG. 4, with the addition of a prime symbol. The top 54 of stem 52' has an increased diameter relative to the remainder of stem 52'. Cam groove 58' is disposed between stem 52' and main body 56'. From cam groove 58' main body 56' increases in width as it approaches lower portion 62'. Moveable contact M has button contact elements 84' and 86' disposed on the bottom side of conductive strip 82'. A contact for actuating a dynamic braking mechanism is not provided in switch 10', but switch 10' otherwise operates in substantially the same manner as switch 10.

Figure 5:
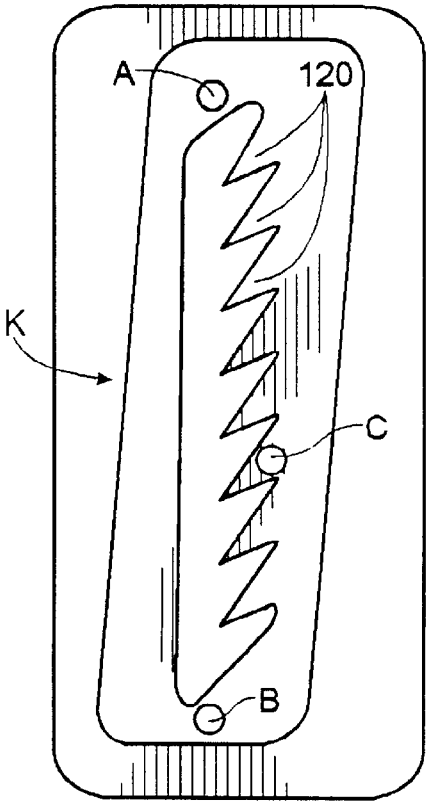
FIG. 5 is a side view of a multi-toothed cam according to yet another embodiment of the present invention.

FIG. 5 shows an alternate design for cam K in which a plurality of lobes 120 are provided on inner solid portion 44. Reference letter A shows the position of pin 78 when plunger P is not actuated. Reference letter B shows the position of pin 78 when plunger P is actuated. Reference letter C shows the position of pin 78 in a fail-safe condition where further actuation of plunger P is prevented. A switch using the cam shown in FIG. 5 operates in a similar manner as switch 10 in FIG. 2.

Figure 6:
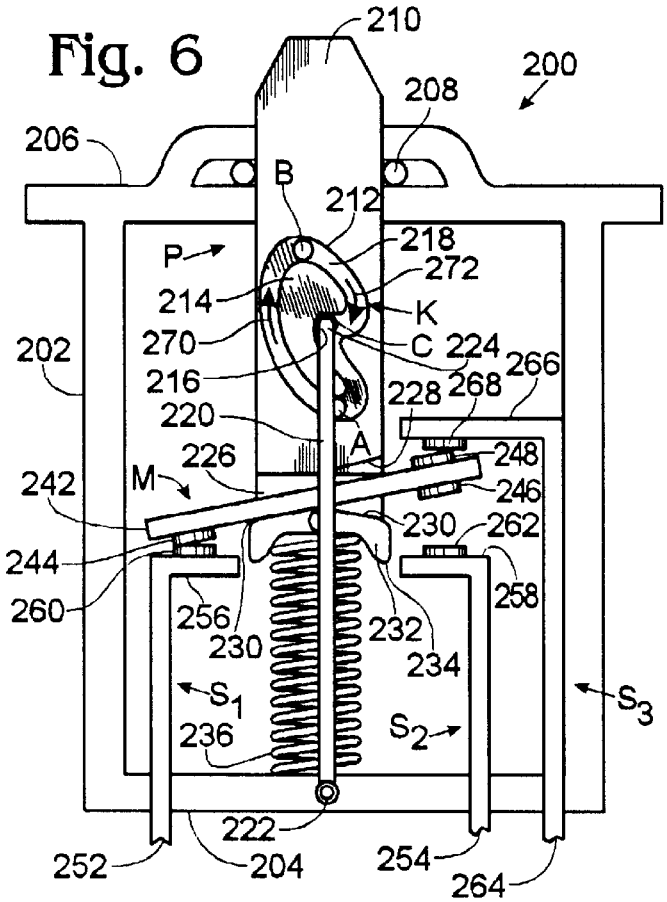
FIG. 6 is a cutaway view of another embodiment of the present invention.

It is possible to invert the internal structure of switch 10 so that a housing-mounted follower contacts a plunger-mounted cam. FIG. 6 shows such an embodiment. Switch 200 has a housing 202 having a bottom 204 and a top 206. Plunger P extends through top 206 and is supported by o-ring seal 208. Stem 210 has a chamfered top.

Cam K is mounted on one side of plunger P. Cam K has an outer ridge 212, an inner solid portion 214 with a lobe 216, and a track 218. Track 218 is defined by outer ridge 212 and inner solid portion 214. Wire 220 has a first end 222 mounted in bottom 204 of housing 202. The wire has a second end 224 which is disposed in track 218. Second end 224 moves along track 218 as cam K moves vertically. Wire 220 is made of a flexible and resilient material.

Lower end of plunger P has a moveable contact slot 226. Upper surface 228 of moveable contact slot 226 is partially angled upward, and lower surface 230 of moveable contact slot 226 is angled downward. The bottom of plunger P comprises a bracket 232 having an annular lip 234. Spring 236 upwardly biases plunger P and is held in place by annular lip 234. Spring 236 is attached to bottom 204 of housing 202.

Moveable contact M is placed in moveable contact slot 226. Moveable contact M comprises a conductive strip 242 and three button contact elements 244, 246, 248. Downward-facing button contact elements 244 and 246 are disposed on the lower side of conductive strip 242. Upward-facing button contact element 248 is disposed on the upper side of the conductive strip.

Terminal contacts $S_1$, $S_2$ have terminal ends 252, 254 extending through bottom 204 of housing 202. Each terminal contact $S_1$, $S_2$ has an angled end 256, 258 with an upwardly facing button contact element 260, 262 attached thereto, respectively. Terminal contact $S_3$ has a terminal end 264 extending through bottom 204 of housing 202. Terminal contact $S_3$ has an angled end 266 with a downwardly facing button contact element 268. Button contact elements 260, 262, 268 are respectively aligned with button contact elements 244, 246, 248 on moveable contact M as shown in FIG. 6.

When switch 200 is in a non-actuated state under normal conditions, spring 236 biases plunger P and moveable contact M away from terminal contacts $S_1$ and $S_2$. Button contact element 248 contacts button contact element 268. Second end 224 of wire 220 is at non-actuated position A in track 218. When the switch is actuated under normal conditions, cam K moves vertically downward. Since first end 222 of wire 220 is mounted in bottom 204 of housing 202, second end 224 is prevented from substantially moving vertically. Second end 224 remains within track 218 as it moves to actuated position B along the path shown by arrow 270. In this condition, button contact elements 244 and 246 contact button contact elements 260 and 262, respectively. Current runs through conductive strip 242. The electrical connection between terminal ends 252 and 254 is made.

Under normal conditions, release of plunger P will result in switch 200 returning to the non-actuated state as described above. Cam K moves in an upward direction. Second end 224 is returned to non-actuated position A along the path shown by arrow 272. The force of spring 236 is sufficient to move cam K upward without second end 224 becoming trapped in lobe 216. However, if button contact element 244 becomes welded to button contact element 260, release of plunger P will not result in second end 224 returning to non-actuated position A. The welded contact button elements 244, 260 only allow movement of cam K so that second end 224 moves to fail-safe position C adjacent lobe 216. In this state, cam K is prevented from moving downward because second end 224 is trapped in lobe 216. In addition, cam K is prevented from moving upward because of the weld between button contact elements 244, 260. Second end 224 therefore stays at fail-safe position C as long as any button contact elements 244, 246, 260, 262 are in a welded condition. Since cam K is attached to plunger P, the plunger is also prevented from moving vertically. Switch 200 is thereby rendered inoperative as long as a welded condition exists between button contact elements 244 and 260, or between button contact elements 246 and 262. As shown in FIG. 6, spring 236 forces moveable contact M upward so that button contact element 246 is prevented from contacting button contact element 262. Upper and lower surfaces 228, 230 of moveable contact slot 226 allow moveable contact M to be positioned to allow button contact element 248 to contact button contact element 268. Current flows between terminal contact $S_1$, through moveable contact M, and to terminal contact $S_3$. A dynamic braking mechanism (not shown) can thereby be activated, which further enhances the safety of the mechanism in which switch 200 is used.

Figure 7:
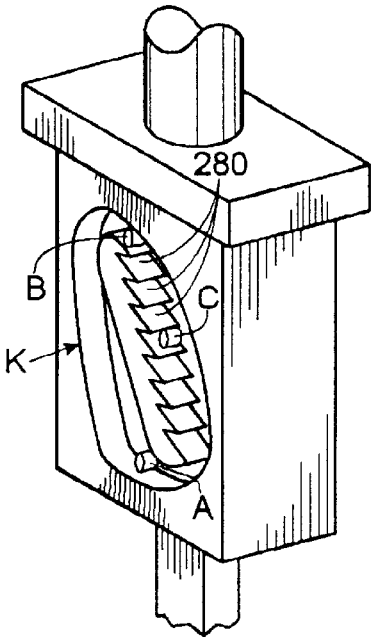
FIG. 7 is a side view of a multi-toothed cam according to another embodiment of the present invention.

FIG. 7 shows an alternate design for cam K in which a plurality of lobes 280 are provided on inner solid portion 214. Reference letter A shows the position of second end 224 when plunger P is not actuated. Reference letter B shows the position of second end 224 when plunger P is actuated. Reference letter C shows the position of second end 224 in a fail-safe condition where further actuation of plunger P is prevented. A switch using the cam shown in FIG. 7 operates in the same manner as switch 200 in FIG. 6.

Figure 9:
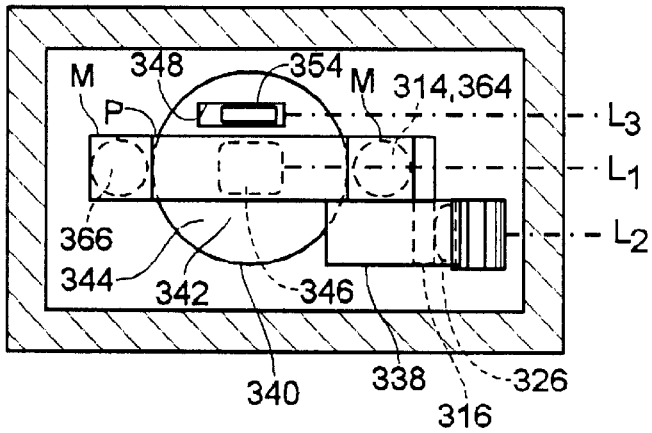
FIG. 9 is a top view, of another embodiment of the present invention.
Figure 10:
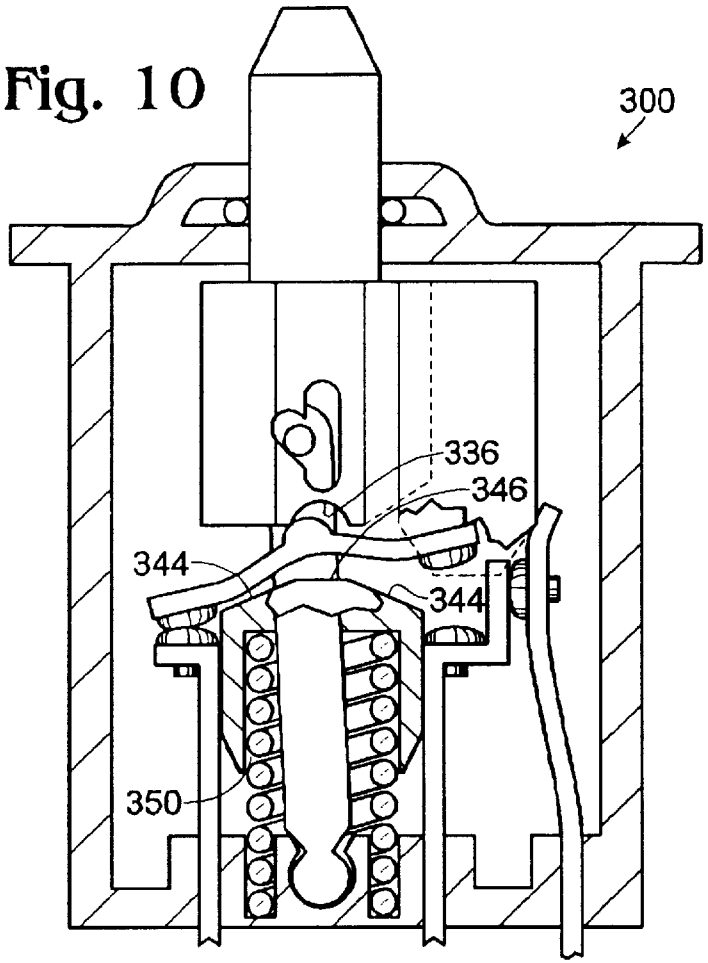
FIGS. 8 and 10 are side views.
Figure 8:
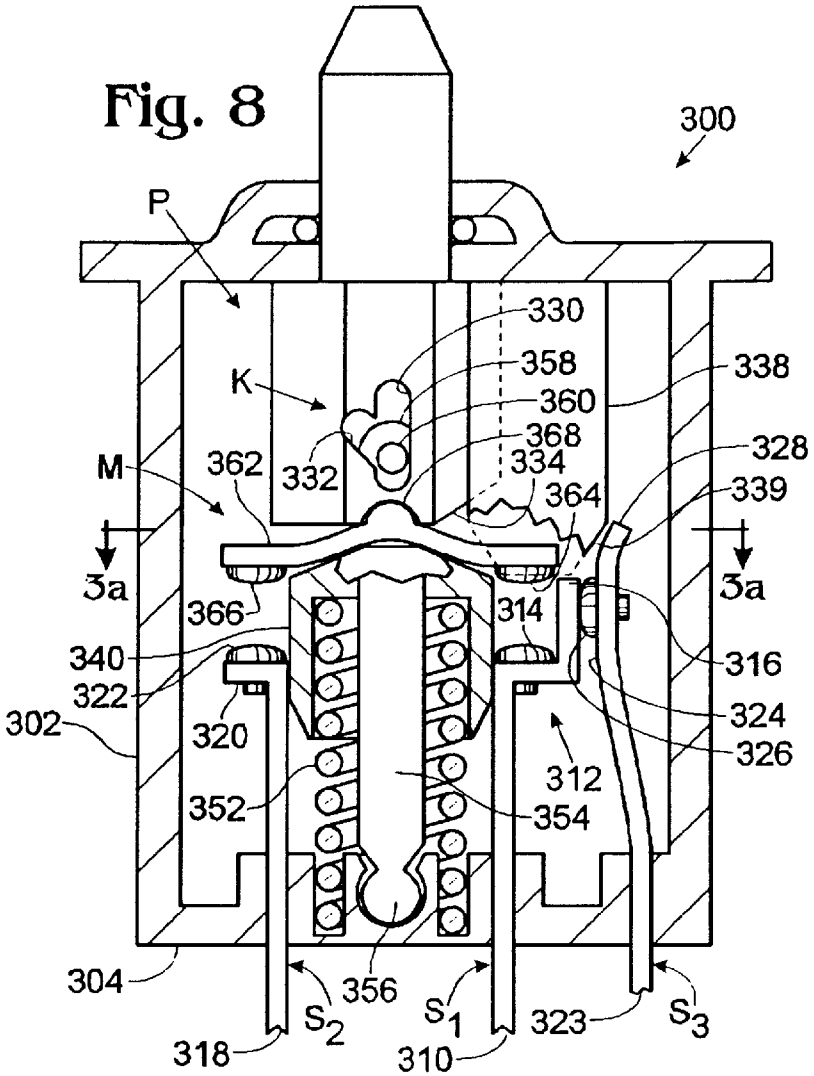

FIGS. 8, 9 and 10 show another embodiment of the present invention in which a housing-mounted follower contacts a plunger-mounted cam. Switch 300 has a housing 302. Housing 302 has a bottom 304. Terminal contacts $S_1$, $S_2$, and $S_3$ have terminal ends 310, 318, and 323, respectively, which extend through bottom 304 as in previous embodiments. Terminal contact $S_1$ has an angled end 312 and a button contact element 314. As shown in FIG. 9, button contact element 314 lies in a first vertical alignment plane $L_1$. Angled end 312 also has an upwardly directed vertical extension 316. Vertical extension 316 lies in a second vertical alignment plane $L_2$. External power contact $S_2$ has an angled end 320 and a button contact element 322. Button contact element 322 lies in plane $L_1$. Terminal contact $S_3$ is connected to a dynamic braking mechanism (not shown). However, unlike previous embodiments, terminal end 323 and contact end 324 of terminal contact $S_3$ are parallel to each other. A button contact element 326 is disposed on contact end 324. Button contact element 326 lies in plane $L_2$ and is biased to contact vertical extension 316 of terminal contact $S_1$. This biasing can be accomplished by forming terminal contact $S_3$ of a resilient conductive material so that terminal contact $S_3$ acts as a leaf spring. Terminal contact $S_3$ can alternatively be biased by a spring (not shown) disposed between housing 302 and terminal contact $S_3$. When button contact element 326 contacts vertical extension 316, electric current flows between terminal contacts $S_1$ and $S_3$ and a dynamic braking mechanism (not shown) is activated.

Switch 300 has a plunger P. A cam surface K in the form of a slot is disposed on plunger P. Slot K is preferably disposed in plane $L_1$. Slot K has a vertical track 330 and a trap 332. Plunger P has an angled lower edge 334. Plunger P also has a seat 336 which is disposed in plane $L_1$.

Tab 338 is attached to plunger P. Tab 338 is substantially disposed in plane $L_2$. Tab 338 has an angled surface 339 designed to contact bent tip 328 of stationary power contact $S_3$ as plunger P is actuated.

Cap 340 has a top surface 342 with an inclined area 344 and a flattened area 346. As best seen in FIG. 9, top surface 342 also has an opening 348 which is disposed in a third vertical alignment plane $L_3$. Interior 350 of cap 340 is designed to house a spring 352. Spring 352 provides an upward biasing force to cap 340. Spring 352 is mounted on bottom 304 of housing 302.

A pivot arm 354 has a base 356 which is rotatably mounted to bottom 304 of housing 302. Pivot arm 354 is generally disposed in third vertical alignment plane $L_3$. Pivot arm 354 extends through opening 348 in cap 340. Distal end 358 of pivot aim 354 has a cam follower in the form of a pin 360. Pin 360 is disposed to move within slot K.

Moveable contact M is provided between plunger P and cap 340 and is generally disposed in first vertical alignment plane $L_1$. Moveable contact M comprises a conductive strip 362 and button contact elements 364, 366 which are adapted to contact button contact elements 314, 322, respectively. Moveable contact M rests on flattened area 346 on cap 340. Moveable contact M also comprises a boss 368 which is normally disposed in seat 336. The upward biasing force of spring 352 ensures that moveable contact M is held between and moves with plunger P and cap 340 during normal operation of switch 300. Moveable contact M can move vertically with respect to pivot arm 354 but is constrained to move horizontally with pivot arm 354. Moveable contact M is designed so that when plunger P is actuated, button contact elements 364, 314 will always contact each other before button contact elements 366, 322 contact each other. In addition, when plunger P is released, button contact elements 366, 322 will always break contact with each other before button contact elements 364, 314 break contact with each other. In other words, the button contact elements which are associated with external power contact $S_2$ will always be "last to make" contact and "first to break" contact. This design guarantees that as switch 300 is used in a normal condition, any electrical arcing and resultant welding will always occur between button contact elements 366 and 322 and not between button contact elements 364 and 314.

FIG. 8 shows switch 300 in a non-actuated state under normal conditions. Spring 352 upwardly biases cap 340, moveable contact M, and plunger P. Button contact elements 364, 366 are biased out of contact with button contact elements 314, 322, respectively. Button contact element 326 on terminal contact $S_3$ contacts vertical extension 316 on terminal contact $S_1$, and the dynamic braking mechanism (not shown) is actuated. When switch 300 is actuated under normal conditions, plunger P, tab 338, moveable contact M, and cap 340 move together in a downward direction. Angled surface 339 of tab 338 contacts bent tip 328 of terminal contact $S_3$ and moves contact end 324 away from vertical extension 316. When contact end 324 is separated from vertical extension 316, electrical current to the dynamic braking mechanism (not shown) is interrupted. Slot K is moved with plunger P so that pin 360 is positioned at the top of vertical track 330. Contact is made between button contact elements 364 and 314. Contact is then made between button contact elements 366 and 322. Current runs through conductive strip 362. The electrical connection between terminal ends 310 and 318 is made.

Under normal conditions, release of plunger P causes switch 300 to return to the non-actuated state. Spring 352 upwardly biases plunger P, tab 338, moveable contact M, and cap 340. Contact is broken between button contact elements 366 and 322. Contact is then broken between button contact elements 364 and 314. Slot K moves with plunger P so that pin 360 is positioned at the bottom of vertical track 330 as shown in FIG. 8. Contact end 326 moves into contact with vertical extension 316 and the dynamic braking mechanism (not shown) is once again actuated. If button contact elements 366, 322 become welded together, spring 352 forces button contact elements 364, 314 out of contact with each other. Moveable contact M can be partially forced upward by spring 352 so that plunger P and cap 340 also partially move upward. Contact end 326 moves into contact with vertical extension 316 and the dynamic braking mechanism (not shown) is actuated. Moveable contact M rotates to the position shown in FIG. 10. Boss 368 comes out of seat 336 and is moved slightly to the left with respect to plunger P. Since pivot arm 354 is constrained to move horizontally with moveable contact M, pivot arm 354 is also moved to the left with respect to plunger P.

Therefore, pin 360 moves into trap 332 as the plunger-mounted slot K moves upward. As in previous embodiments, button contact elements 364 and 314 are prevented from contacting each other when button contact elements 366 and 322 are welded together. Plunger P cannot return to the non-actuated position because of the welded button contact elements 322, 366. Plunger P cannot return to the actuated position because pin 360 is in trap 332. Switch 300 is therefore rendered inoperable.

Figure 16:
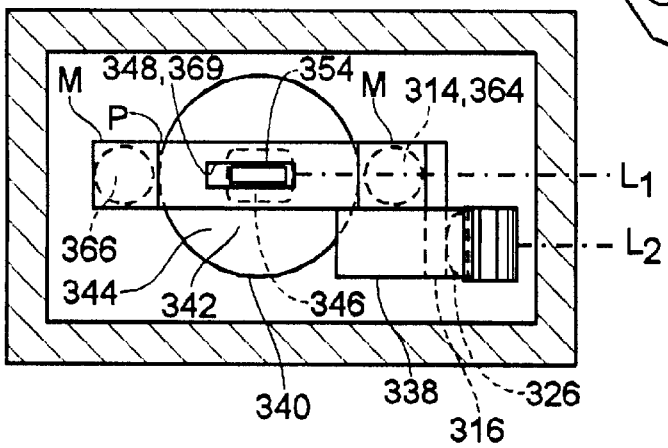
FIG. 16 is a top view of a variation of the embodiment shown in FIGS. 8–10.

FIG. 16 shows a variation on the embodiments shown in FIGS. 8–10 wherein third vertical alignment plane $L_3$ is eliminated. Pivot arm 354 and opening 348 are placed in first vertical alignment plane $L_1$. Moveable contact M is provided with a contact opening 369, similar in size to opening 348, which enables the pivot arm to pass through the moveable contact without interfering with the operation of the moveable contact.

The embodiments of the present invention disclosed thus far have as a common denominator a cycle control surface, shown as a cam, mounted either on a moveable plunger or on a stationary switch housing. A contacting member, shown as a cam follower, is complementarily attached to the housing or to the moveable plunger, respectively. The follower cycles around a cam track when the plunger is actuated. However, the present invention can also be expressed in embodiments in which the cycle control surface and the contacting member take other forms.

FIGS. 11 and 12 show an exemplary embodiment in which the cycle control surface of the present invention takes the form of a ratchet and the contacting member takes the form of a swing arm. Swing arm 400 has a setting portion 402 on one end and a resetting portion 404 on an opposite end. A ratchet engaging portion 406 is provided between setting portion 402 and resetting portion 404. Swing arm 400 is pivotally attached to plunger P at pivot point 408. Spring 410 has a first end 412 attached to swing arm 400 at attachment point 414. Spring 410 has a second end 416 attached to plunger P using a boss 418. When swing arm 400 is in the unstable state T as shown in solid lines in FIG. 11, spring 410 is stretched and biases swing arm 400 to rotate about pivot point 408 either in a clockwise or a counterclockwise direction to one of two stable states U, V. Stable states U, V are shown in dashed lines in FIG. 11. When swing arm 400 is in one of stable states U, V, the biasing force of spring 410 on swing arm 400 is substantially lessened or eliminated. An external force is required to move swing arm 400 through unstable state T to the other of the stable states V, U.

Ratchet R is attached to a switch housing 420. Ratchet R has a plurality of ratchet teeth 422 designed to contact ratchet engaging portion 406 of swing arm 400. Ratchet R has a resetting lip 424 which contacts resetting portion 404 of swing arm 400. A wall 426 of housing 420 has a sloped surface 428 which contacts setting portion 402. The ratchet mechanism of the present embodiment also includes a moveable contact, a biasing spring, stationary contacts, and other necessary structure, all of which are shown in previous embodiments. One of ordinary skill will be able to replace the cam mechanism in the previously disclosed switches with the ratchet mechanism of the present embodiment.

When plunger P is actuated, swing arm 400 is in stable state V in position W as shown in FIG. 12. Ratchet engaging portion 406 does not contact ratchet teeth 422. As plunger P approaches the maximum point of downward actuation, setting portion 402 of swing arm 400 contacts sloped surface 428 as shown at X. Sloped surface 428 forces swing arm 400 to rotate clockwise from stable state V, through unstable state T, to stable state U. When plunger P reaches the maximum point of downward actuation, which corresponds to a state in which the switch completes an electrical circuit, sloped surface 428 has forced swing arm 400 into stable state U.

As with previous embodiments, plunger P moves upward when released. Ratchet engaging portion 406 contacts ratchet teeth 422 as shown at Y. The topology of the ratchet teeth is such that the ratchet engaging portion moves substantially along the ratchet teeth, yet the swing arm does not completely move to unstable state T. If the switch of the present embodiment is operating normally, ratchet engaging portion 406 contacts ratchet teeth 422 until plunger P approaches its maximum point of upward travel. Resetting portion 404 contacts resetting lip 424 on ratchet R as shown at Z. The resetting lip forces the swing arm to rotate counterclockwise from stable state U, through unstable state T, to stable state V. When plunger P reaches its maximum point of upward travel, resetting lip 424 has forced swing arm 400 to stable state V so that ratchet engaging portion 406 does not contact ratchet teeth 422.

If as in previous embodiments one pair of contacts becomes welded, swing arm 400 will travel only partially upward as ratchet engaging portion 406 contacts ratchet teeth 422. The welded contacts prevent swing arm 400 and plunger P from traveling upward. Ratchet engaging portion 406 prevents swing arm 400 and plunger P from traveling downward. Swing arm 400 cannot disengage ratchet R because swing arm 400 cannot move out of stable state U. The switch of the present embodiment is thereby inoperative.

As with previous embodiments, the embodiment in FIGS. 11 and 12 can be inverted so that ratchet R moves with plunger P and swing arm 400 is attached to switch housing 420 at pivot point 408.

FIG. 13 shows a variation on the swing-arm embodiment of the present invention in which the cycle control surface takes the form of a ratchet R and the contacting member takes the form of a hook arm 450. Arm 450 comprises a wire 452 attached at one end to a pivot 454 mounted on a plunger P. Pivot 454 allows arm 450 to rotate with respect to plunger P. Wire 452 has a bent end 456 which contacts ratchet teeth 422 of ratchet R. A spring 460 is attached to wire 452 at attachment point 462 and is rotatably attached to plunger P using a spring anchor 464. Spring anchor 464 allows spring 460 to rotate with respect to plunger P. Arm 450 operates in a manner similar to swing arm 400, and reference should be made to the preceding description of the operation of swing arm 400. When plunger P is actuated, arm 450 does not contact ratchet teeth 422. When plunger P reaches the lowest point of actuation, bent end 456 of arm 450 is caused to move into contact with ratchet teeth 422. Bent end 456 contacts ratchet teeth 422 as plunger P is released. When plunger P reaches its highest point of travel, bent end 456 is caused to move out of contact with ratchet.

Figure 15:
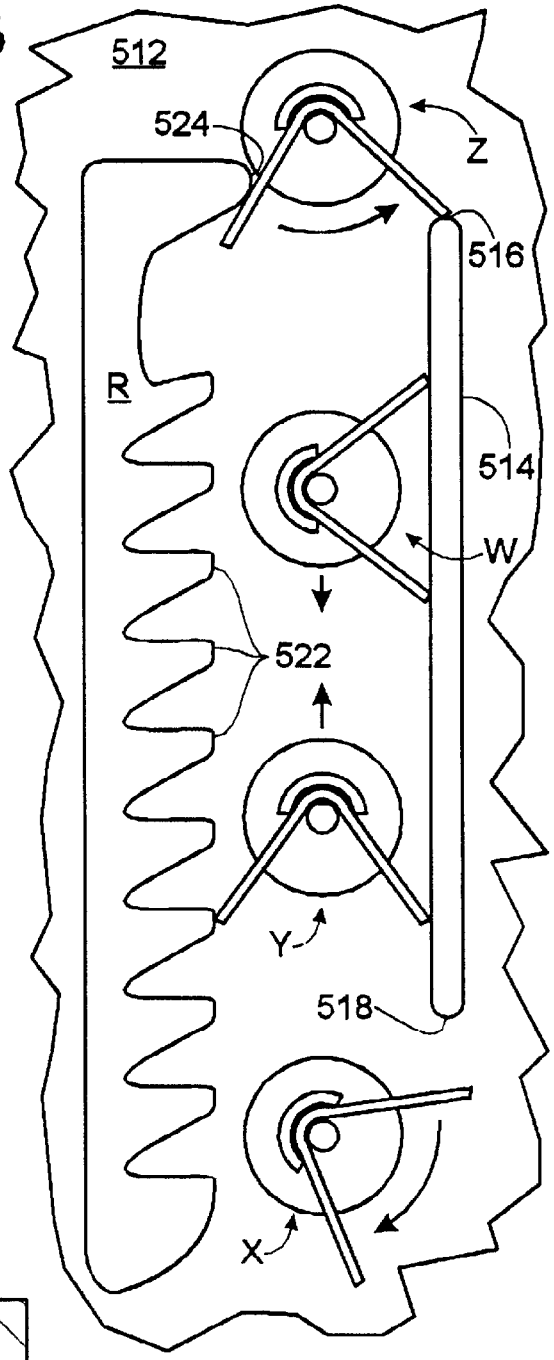
FIGS. 14 and 15 show a U-shaped arm and ratchet mechanism according to still another embodiment of the present invention.
Figure 14:
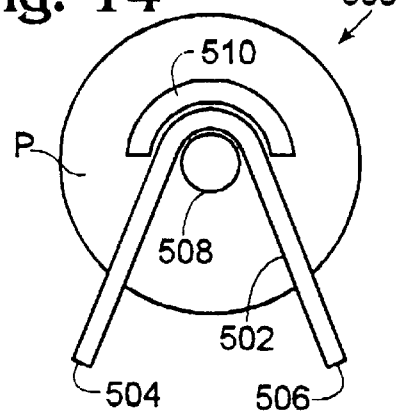

FIGS. 14 and 15 show another embodiment of the present invention in which the cycle control surface takes the form of a ratchet R and the contacting member takes the form of a U-shaped arm 500. U-shaped arm 500 is shown in an upright position in FIG. 14. Arm 500 is attached to a switch plunger P. Arm 500 has a wire 502 with first and second ends 504, 506. Wire 502 is held in a bent position by boss 508 and guide 510. Switch housing 512 comprises a wall 514 having an upper edge 516 and a lower edge 518. Switch housing 512 further comprises a ratchet R. Ratchet R has a plurality of ratchet teeth 522 and a lip 524. Arm 500 is disposed between wall 514 and ratchet R. A tension or torsion-type spring (not shown) biases arm 500 to swing clockwise from the position shown in FIG. 14.

When arm 500 is at non-actuated position Z in FIG. 15, first end 504 of wire 502 contacts lip 524. Arm 500 is prevented from swinging in a clockwise direction. As arm 500 moves downward, second end 506 contacts upper edge 516 of wall 514. Further downward motion of arm 500 forces the arm to swing in a counterclockwise direction to position W. Ends 504, 506 of wire 502 substantially contact wall 514 and prevent arm 500 from swinging in a clockwise direction as arm 500 moves downward. As arm 500 approaches a fully-actuated position, ends 504, 506 move below lower edge 518 of wall 514. Arm 500 swings clockwise as shown at X due to the biasing force of the spring (not shown). First end 504 of wire 502 can now contact ratchet teeth 522 as arm 500 moves upward. This is shown as position Y. When a pair of contacts become welded together, arm 500 does not return to non-actuated position Z because of the welded contact and cannot return to the fully-actuated position because first end 504 engages ratchet teeth 522. Plunger P is thereby rendered inoperative.

The foregoing description of the preferred embodiments of the invention has been presented for purposes of illustration and description. It is not intended to be exhaustive or to limit the invention to the precise form disclosed, and many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A safety switch, comprising:

first and second terminal contacts;

a contactor structure including first and second contactor contacts electrically connected to each other, the switch having an "on" state in which the first and second terminal contacts are contacted with the first and second contactor contacts, respectively, to thereby electrically connect the terminal contacts therebetween, the switch further having an "off" state in which the terminal contacts are not electrically connected to each other by the contactor structure whereby current cannot flow between the terminal contacts; and a cycle control mechanism having a normal-state in which the switch is free to cycle between the "on" and "off" states, the cycle control mechanism further having a welded-state in which one of the terminal contacts is welded to one of the contactor contacts and the other of the contactor contacts is separated from the other of the terminal contacts, wherein in the welded-state the cycle control mechanism prevents the switch from moving from the "off" state to the "on" state.

2. The safety switch of claim 1, further including an actuating mechanism, which when actuated causes the electrical connection to be made, and when released causes the electrical connection to be interrupted, and wherein the cycle control mechanism includes a cycle control surface disposed in relation to the actuating mechanism, the cycle control surface comprising at least one trap;

a contacting member operationally contacting at least part of the cycle control surface as the actuating mechanism is actuated and released;

wherein at least one of the cycle control surface and contacting member moves with respect to the other of the cycle control surface and the contacting member when the cycle control mechanism is in the normal-state; and wherein when the cycle control mechanism is in the welded-state, the contacting member is prevented from leaving the at least one trap, thereby preventing the switch from returning to the "on" state.

3. The switch of claim 2, wherein:

the contacting member comprises a swing arm moveable between a first position in which the swing arm contacts the cycle control surface, and a second position in which the swing arm does not substantially contact the cycle control surface;

the cycle control surface including a portion which operationally contacts the swing arm to move the swing arm from the first position to the second position;

the switch further including a setting surface which operationally contacts the swing arm to move the swing arm from the second position to the first position.

4. The switch of claim 2, wherein:

the contacting member comprises a wire having a first end, the wire being moveable between a first position in which the wire contacts the cycle control surface, and a second position in which the wire does not substantially contact the cycle control surface;

the cycle control surface including a portion which operationally contacts the wire to move the wire from the first position to the second position;

the switch further including a setting surface which operationally contacts the wire to move the wire from the second position to the first position.

5. The switch of claim 2, wherein during normal operation of the switch the contacting member is substantially constrained to follow the cycle control surface as the actuating mechanism is actuated and released.

6. The switch of claim 5, wherein the cycle control surface is stationary relative to the actuating mechanism, and the contacting member is movably disposed on the actuating mechanism.

7. The switch of claim 6, wherein the cycle control surface comprises a cam disposed on a housing, and the contacting member comprises a cam follower.

8. The switch of claim 7, wherein the cam follower is constrained to move with the actuating mechanism in a first direction in which the actuating mechanism is actuated and released, but is free to move relative to the actuating mechanism in a second direction substantially normal to the first direction, as the cam follower follows the cam.

9. The switch of claim 5, wherein the cycle control surface is disposed on the actuating mechanism.

10. The switch of claim 9, wherein the contacting member comprises a wire having a first end which is operationally attached to a switch housing, and a second end which contacts the cycle control surface.

11. The switch of claim 9, further comprising:

a pivot arm rotatably mounted on a switch housing, wherein the contacting member is attached to the pivot arm.

12. The switch of claim 9, wherein the cycle control surface comprises a slot.

13. The switch of claim 2, wherein the actuating mechanism is biased to a position in which the electrical connection is interrupted.

14. The switch of claim 2, wherein the first contact area is biased to contact one of the terminal contacts after the second contact area contacts the other of the terminal contacts.

15. The switch of claim 14, wherein the first contact area is biased to break contact with one of the terminal contacts before the second contact area breaks contact with the other of the terminal contacts.

16. The safety switch of claim 1, wherein the cycle control mechanism has a path-following element which is moveable along a first path as the switch is actuated from the "off" state to the "on" state, the path-following element moveable along a second path as the switch is actuated from the "on" state to the "off" state, wherein the path-following element moves in only one direction along at least part of the second path.

17. A switch for interrupting an electrical connection between two terminal contacts, comprising:

a plunger, which when actuated causes the electrical connection to be made, and when released causes the electrical connection to be interrupted;

a conductive element, the positions of the terminal contacts and the conductive element with respect to each other being dependent on the position of the plunger, the conductive element having first and second contact areas, each of the contact areas being selectively and operationally connected and disconnected with one of the terminal contacts, respectively;

a cycle control surface disposed in relation to the plunger, the cycle control surface comprising at least one trap;

a contacting member which operationally contacts at least part of the cycle control surface as the plunger is actuated and released;

wherein at least one of the cycle control surface and the contacting member moves with respect to the other of the cycle control surface and the contacting member when the plunger is released and the first and second contact areas and the terminal contacts are not prevented from being operationally disconnected from each other; and wherein when the plunger is released and one of the contact areas and one of the terminal contacts are prevented from being operationally disconnected from each other, the contacting member is prevented from leaving the at least one trap, thereby restraining movement of the contacting member and the cycle control surface with respect to each other, and thereby preventing the electrical connection between the two terminal contacts.

18. A vehicle, comprising:

a source of electrical power;

a drive train controlled by the source of electrical power and operable to move the vehicle;

a safety switch operationally connecting the source of electrical power and the drive train, the switch actuatable between an "on" state in which the source of electrical power transmits motive power to the drive train and an "off" state in which electrical power is not transmitted to the drive train by the source of electrical power, the safety switch including first and second terminal contacts;

a contactor structure including first and second contactor contacts electrically connected to each other, the switch having an "on" state in which the first and second terminal contacts are contacted with the first and second contactor contacts, respectively, to thereby electrically connect the terminal contacts therebetween, the switch further having an "off" state in which the terminal contacts are not electrically connected to each other by the contactor structure whereby current cannot flow between the terminal contacts; and a cycle control mechanism having a normal-state in which the switch is free to cycle between the "on" and "off" states, the cycle control mechanism further having a welded-state in which one of the terminal contacts is welded to one of the contactor contacts and the other of the contactor contacts is separated from the other of the terminal contacts, wherein in the welded state the cycle control mechanism prevents the switch from moving from the "off" state to the "on" state.

* * * * *